US006044160A

United States Patent [19]

Norris

[11] Patent Number: 6,044,160

[45] Date of Patent: Mar. 28, 2000

[54] RESONANT TUNED, ULTRASONIC ELECTROSTATIC EMITTER

[75] Inventor: Elwood G. Norris, Poway, Calif.

[73] Assignee: American Technology Corporation, San Diego, Calif.

[21] Appl. No.: 09/006,133

[22] Filed: Jan. 13, 1998

[51] Int. Cl.[7] ..... H04R 25/00

[52] U.S. Cl. ..... 381/191; 381/116; 381/174

[58] Field of Search ..... 381/312, 320, 381/321, 113, 116, 345, 174, 190, 191, 173, 98, 61, 79; 310/324, 327, 334, 800; 455/91, 108; 367/140; 29/594, 25.35

[56] References Cited

U.S. PATENT DOCUMENTS

| | | |
|---|---|---|
| 3,908,098 | 9/1975 | Kawakami et al. . |
| 3,961,291 | 6/1976 | Harper et al. . |
| 4,429,193 | 1/1984 | Busch-Vishniac et al. . |
| 4,439,642 | 3/1984 | Reynard . |
| 4,558,184 | 12/1985 | Busch-Vishniac . |
| 4,809,355 | 2/1989 | Drefahl . |
| 4,908,805 | 3/1990 | Sprenkels et al. . |
| 5,287,331 | 2/1994 | Schindel . |
| 5,357,578 | 10/1994 | Shinnosuke Taniishi . |

OTHER PUBLICATIONS

Masahide Yoneyama, Jun–ichiroh Fujimoto, Yu Kawamo, Shoichi Sasabe "*Audio Spotlight: An Application of Nonlinear Interaction of Sound Waves to a New Type of Loadspeaker Design*" J. Acoustical Society of America 75(5), May 1983, pp. 1532–1536.

H.O. Berktay, T.G. Muir "*Arrays of Parametric Receiving Arrays*" The Journal of the Acoustical society of America, pp. 1377–1383, vol. 53, No. 5, 1973.

Kenichi Aoki, Tomoo Kamakura, Yoshiro Kumamoto "*Parametric Loudspeaker—Characteristics of Acoustic Field and Suitable Modulation of Carrier Ultrasound*" Electronics and Communications in Japan, Part 3, vol. 74, No. 9, 1991, pp. 76–80.

P. Rangsten, L. Smith, L. Rosengren, B. Hok "*Electrostatically Excited Diaphragm Driven as a Loudspeaker*" Sensors and Actuators A 52 (1996) pp. 211–215.

*Primary Examiner*—Huyen Le

*Attorney, Agent, or Firm*—Thorpe, North & Western, LLP

[57] ABSTRACT

An ultrasonic emitter device for converting electrical signals to audio output by acoustic heterodyning of ultrasonic emissions. The device comprises a rigid core member having a top surface which includes an array of cavities of predetermined size and means for enhancement of at least one resonant frequency operable as a carrier frequency within an ultrasonic frequency range. An electrostatic field is generated at the top surface of the core member, and operates with respect to a resilient, dielectric diaphragm disposed in tension along the top surface and across the cavities to allow an intended range of orthogonal displacement of emitting sectors of the diaphragm positioned over the cavities and within a strong portion of the electrostatic field. A conductive medium is applied to one face of the diaphragm and is electrically isolated from the core member. A modulating circuit coupled to the conductive medium develops a variable electrostatic field to be applied to the diaphragm which interacts with the electrostatic field of the core member to develop a series of ultrasonic compression waves emanating from the emitting sectors of the diaphragm within the desired ultrasonic resonant frequency range and which propagate the series of ultrasonic compression waves which are demoduled within a nonlinear air medium to generate audio output.

21 Claims, 4 Drawing Sheets

RESONANT TUNED, ULTRASONIC ELECTROSTATIC EMITTER

BACKGROUND OF THE INVENTION

1. Field of the Invention

This invention relates to electrostatic transducers, and in particular to electrostatic emitters operable within the ultrasonic frequency range.

2. Prior Art

Electrostatic emitters have long been utilized to generate compression waves, both in the sonic and ultrasonic frequency ranges. An advantage of this type of speaker is the low mass diaphragm which is less susceptible to distortion caused by the substantial mass of conventional acoustic speakers which rely on the large mass of a magnetic core for generation of compression waves. In view of this feature, many attempts have been made to develop an effective acoustic speaker which supplies full range audio output, yet operates within the very slight diaphragm displacement characteristic of an electrostatic emitter.

The development of an electrostatic acoustic speaker which provides strong bass or low frequency range has been most challenging. Because of the limited range of electrostatic forces, diaphragm displacement must be correspondingly limited. To allow the diaphragm to extend beyond the effective force field of the electrostatic source would result in severe distortion as the tension required within the diaphragm collapses. Therefore, diaphragm displacement is generally limited to distances measured in micrometers. Although such minimal movement may be suitable for high treble ranges, bass response requires electrostatic radiating elements to embody extremely large surface areas to generate sufficient air movement to satisfy listener taste for a strong, low bass output. Such large surface areas, however, are not only difficult to design, but require large wall space within the listener's field of use. This is particularly problematic in view of current market trends for smaller sized acoustic systems which can be concealed, yet generate large sound output.

Among the most common applications of electrostatic emitters is the propagation of ultrasonic radiation, generally for industrial applications such as material testing, range finding, and other utilities not associated with audible sound systems. For example, range detecting devices associated with automatic cameras typically rely on a small electrostatic transmitter comprising a rigid, conductive plate of approximately one inch in diameter. The plate has a series of concentric channels cut into its face to provide displacement space for a thin film of metalized Mylar superimposed over the top of the resulting ridges. When the nonconductive Mylar film is biased in tension against the plate, ultrasonic emissions can be transmitted by applying an ultrasonic frequency to the conductive metalized side of the film, thereby vibrating the film sections which are movable between the ridges. A timing circuit calculates an object distance from the camera based on time delay of the reflected signal and adjusts lens focus accordingly. Such applications are generally represented by U.S. Pat. No. 4,439,642 of Reynard.

The intended application of the ultrasonic emitter will usually determine the ultrasonic frequency range to be applied. This range starts above the audio peak at approximately 20 kHz and extends well into the MHz range. FIG. 1 illustrates the absorption effect of ultrasonic radiation in air, as a function of frequency. It will be noted that severe attenuation occurs at frequencies in the hundred kHz range and up. Therefore, very little utility has been perceived for high frequency ultrasonic applications where sound must be transmitted over significant distances. Applications for the high range frequencies is generally limited to materials testing situations where the emitter and detector are positioned proximate to the material surface. This technology generally illustrated by U.S. Pat. Nos. 4,695,986; 4,887,246; and 4,888,086 by Hassack et al, and by U.S. Pat. No. 4,429,193 of Busch-Vishniac et al.

U.S. Pat. No. 5,287,331 by Schindel illustrates design considerations for extremely high ultrasonic frequency requirements using an electrostatic film. This emitter incorporates a modified electrostatic design developed for operation in the range of ultrasonic emissions up to several MHz. The patent teaches the use of small pits formed in selected shapes and sizes (approximately 40 micrometers). Performance of the electrostatic emitter relies on closed pits which trap air between the rigid substrate and the film diaphragm. The film is retained in this sealed configuration at the pitted surface by suction arising from depressing the film into the cavity structure, and allowing the resulting suction of the closed pit cavities to retain the film in sealed contact.

Although none of the prior art electrostatic emitters suggest beneficial use as a small speaker operable within the low audio range, development of audio from heterodyne interference of two ultrasonic beams is able to generate such low frequency output. Prior art applications of this heterodyning or parametric speaker technology has focused primarily on use of bimorf piezoelectric transducers as the emitter source. These devices offer broad range operation; however, they often lack the sensitivity of an electrostatic system. Despite the many years of research endeavoring to develop a parametric speaker array capable of commercial competition with conventional acoustical speakers, no application of electrostatic emitter design using a thin film has been successfully achieved.

A brief outline of prior art development of parametric speaker design will be helpful to an understanding of the present invention which realizes effective utilization of an electrostatic system for audio sound generation. A general discussion of this technology is found in "Parametric Loudspeaker—Characteristics of Acoustic Field and Suitable Modulation of Carrier Ultrasound", Aoki, Kamadura and Kumamoto, *Electronics and Communications in Japan*, Part 3 Vol. 74, No. 9 (March 1991). Although technical components and the theory of sound generation from a difference signal between two interfering ultrasonic frequencies is described, the practical realization of a commercial sound system was apparently unsuccessful. Note that this weakness in the prior art remains despite the assembly of a parametric speaker array consisting of as many as 1410 piezoelectric transducers yielding a speaker diameter of 42 cm. Virtually all prior research in the field of parametric sound has been based on the use of conventional ultrasonic transducers, typically of bimorph character. The rigid piezoelectric emitter face of such transducers has very little displacement, and is accordingly limited in amplitude. Furthermore, there appears to be no unique design consideration given to the housing casement or position configuration for the emitters.

U.S. Pat. No. 5,357,578 issued to Taniishi in October of 1994 introduced alternative solutions to the dilemma of developing a workable parametric speaker system. Hereagain, the proposed device comprises a transducer which radiates the dual ultrasonic frequencies to generate the desired audio difference signal. However, in this patent the dual-frequency, ultrasonic signal is propagated from a gel medium on the face of the transducer. This medium 20 "serves as a virtual acoustic source that produces the difference tone 23 whose frequency corresponds to the difference between frequencies f1 and f2." Col 4, lines 54–60. In other words, this 1994 reference abandons direct generation of the difference audio signal in air from the face of the transducer, and depends upon the nonlinearity of a gel medium to produce sound. This abrupt shift from transducer/air interface to proposed use of a gel medium reinforces the perception of apparent inoperativeness of prior art disclosures, at least for practical speaker applications attempted to date.

What is needed is a system that provides a strong audio output, including frequencies within the bass range, which can be developed by acoustic heterodyning from an electrostatic speaker operating at frequencies within the ultrasonic range.

OBJECTS AND SUMMARY OF THE INVENTION

It is an object of the present invention to provide a parametric speaker having commercial utility for propagating at least two ultrasonic signals whose difference falls within the audio range to thereby generate audio output when transmitted into a nonlinear medium such as air.

It is a further object of the invention to develop an electrostatic emitter which is specifically tuned to a desired resonant frequency corresponding to a carrier frequency of the heterodyning signals, thereby enhancing the efficiency of the parametric output.

It is yet another object of this invention to provide an electrostatic emitter having many discreet emitter sections to develop a small vibrating sector of film capable of high frequency performance within the ultrasonic range.

It is still another object of the present invention to enable use of an electrostatic film which does not require a voltage biasing circuit to maintain the film in tension at each of the transmission sections.

It is a primary object of this invention to provide an inexpensive electrostatic speaker capable of producing audio compression waves by interference of two ultrasonic signals.

DETAILED DESCRIPTION OF THE PREFERRED EMBODIMENTS

Figure 1:
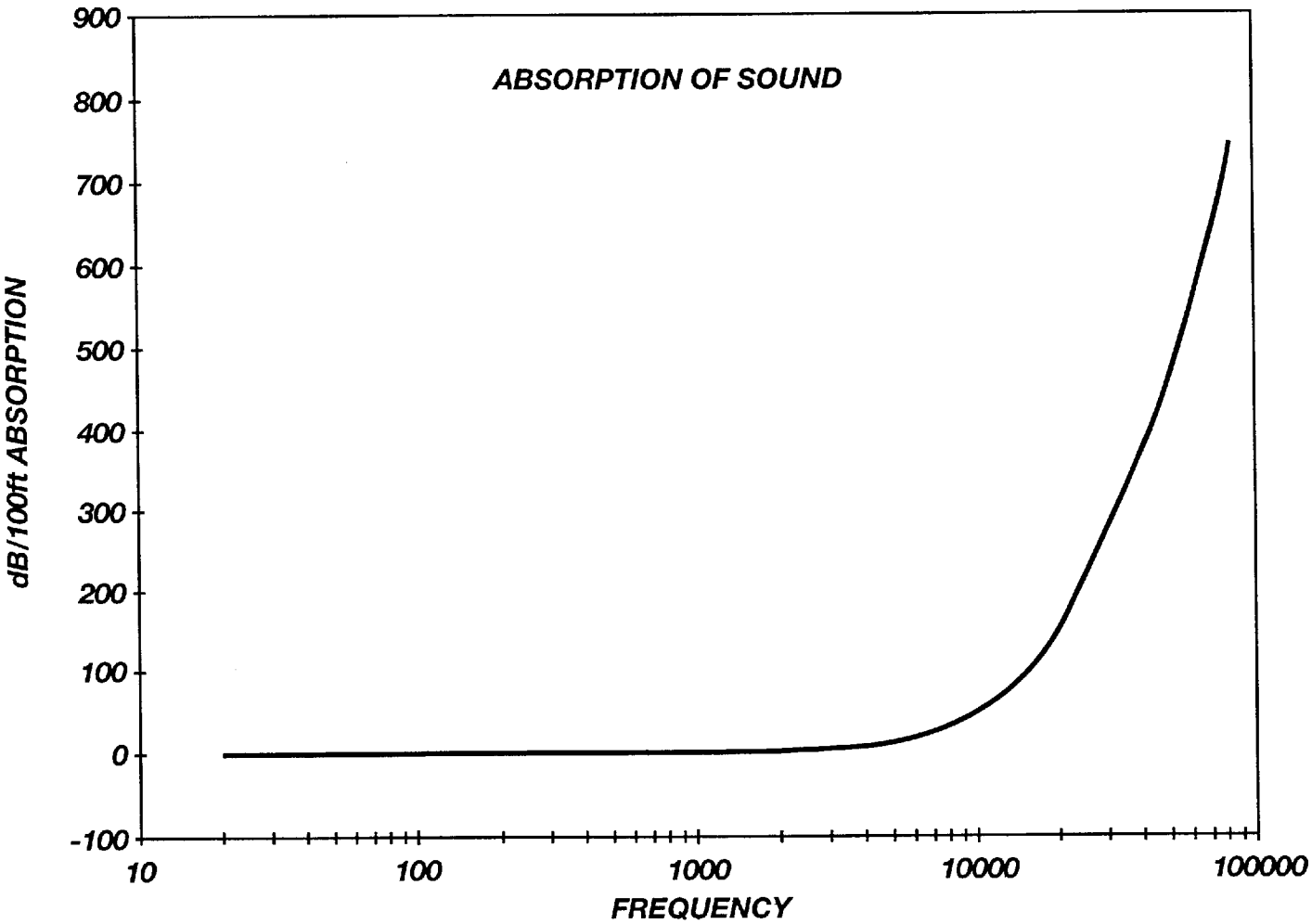
FIG. 1 graphically illustrates the absorption of ultrasonic radiation in air as a function of frequency.
Figure 2:
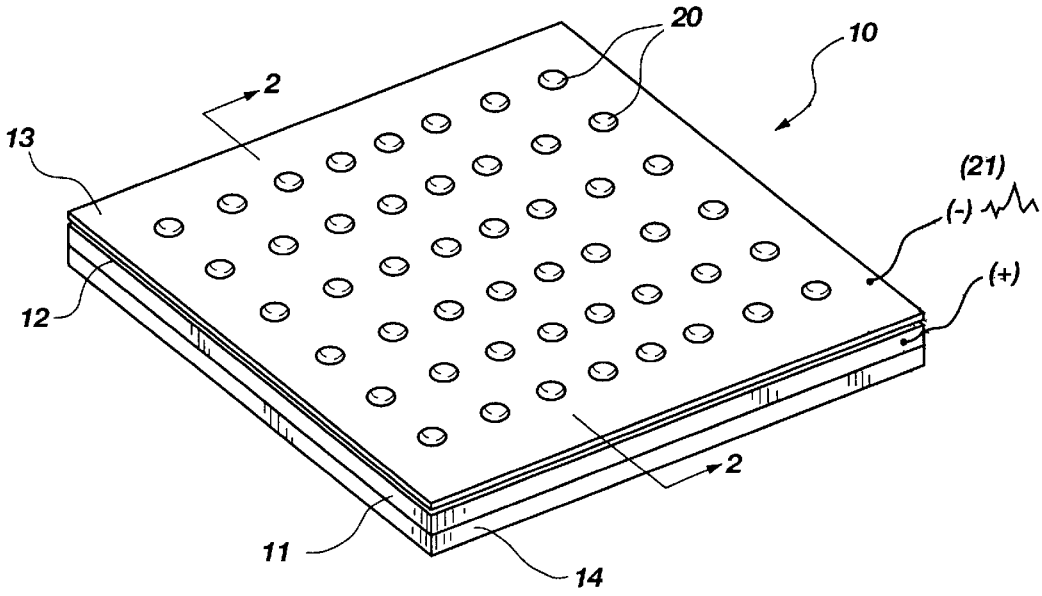
FIG. 2 shows an elevated, perspective view of an electrostatic emitter constructed in accordance with the present invention.

FIG. 2 illustrates an electrostatic emitter 10 embodying the principles of the present invention. Specifically, the emitter comprises a rigid substrate 11 capable of carrying a voltage, a thin film dielectric material 12 suspended over the substrate, and a conductive layer 13 positioned over the dielectric film 12. Typically, the dielectric material 12 (such as Mylar®) is coated with a conductive film 13 directly on its top surface. Therefore, the basic emitter 10 is operable with just the substrate 11 and metallic coated Mylar film 12.

Figure 3:
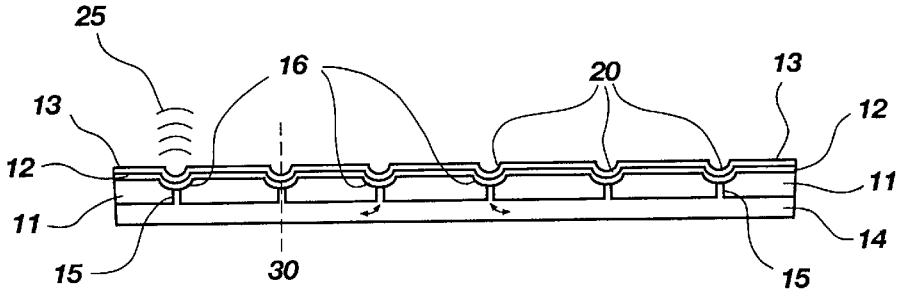
FIG. 3 is a cross section of the emitter of FIG. 2, taken along the lines 3—3.

As shown in FIG. 3, the preferred embodiment also includes an air chamber 14 disposed below the substrate, with small passageways 30 for air flow between the chamber and small cavities 16 formed at a top surface of the substrate. Each of these elements will be discussed in detail as to the cooperative relationship which enables the numerous benefits of the present emitter over the prior art.

Referring to both FIG. 2 and FIG. 3, the rigid substrate 11 may be formed of materials which have previously been applied in electrostatic emitters generally. These include molded plastics, foams or silicon wafers coated at a top side with a conductive surface, or simply conductive materials processed with a top side to include the required cavities. A cross-sectional view of this structure is provided in FIG. 3. The rigid substrate 11 is shown with small conduits 15 communicating from the air chamber 14 to each cavity 16 formed in the top surface of the substrate. This chamber 14 operates as a common plenum, providing a more uniform tension across the dielectric film 12 because of the common pressure associated with the chamber and each connected cavity 16. This chamber 14 can also be subjected to a negative pressure to mechanically bias the thin film 12 into the recessed cup 20 as shown in FIG. 2. Use of biasing pressure avoids well known risks associated with use of a biasing voltage.

It is this recessed cup 20 which becomes the vibrating emitter element which responds to a variable signal input 21 enabling propagation of the ultrasonic carrier signal with side bands which heterodyne to generate a column of audio sound 25. The present invention provides a uniform, recessed cup referred to as an emitter element, which is substantially isolated from the affects of adjacent emitter elements to develop a carefully tuned, resonant frequency of uniform value.

Figure 4:
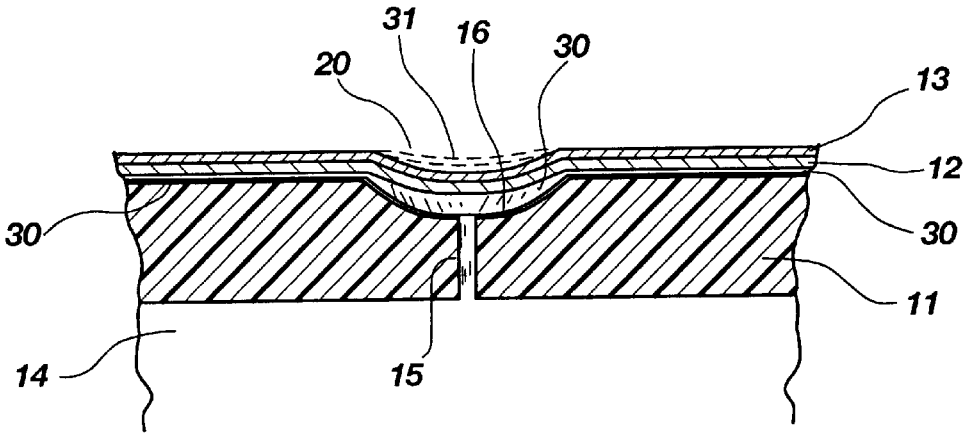
FIG. 4 is an enlarged view of an emitter sector as shown in FIG. 3.

The cavities 16 formed in the substrate 11 are preferably precision molded in uniform size and configuration. This permits a more precise uniformity among the respective cavities 16 to yield a more finely tuned resonant frequency. As shown in FIG. 4, each cavity 16 comprises a concave recess with respect to the top surface of the substrate 11. The depth of concavity is a function of the extent of intended emitter displacement or vibration along an orthogonal axis 30 for each cavity.

The plastic substrate 11 provides a rigid bass which supports the more flexible film or diaphragm 12 so that it may vibrate or oscillate. This vibration occurs at the respective cavities 16 and is responsive to the variation of voltage level applied between the conductive surface 30 of the substrate and the metallic coating 13 of the dielectric film 12 which carries the audio signal modulated onto the ultrasonic carrier wave. This technology of electrostatic conversion of electric signals to mechanical wave propagation is generally well known. Further detail regarding propagation theory is therefore unnecessary to one of ordinary skill in the art. A summary discussion of heterodyne processing of ultrasonic signals, however, will be helpful.

Figure 5:
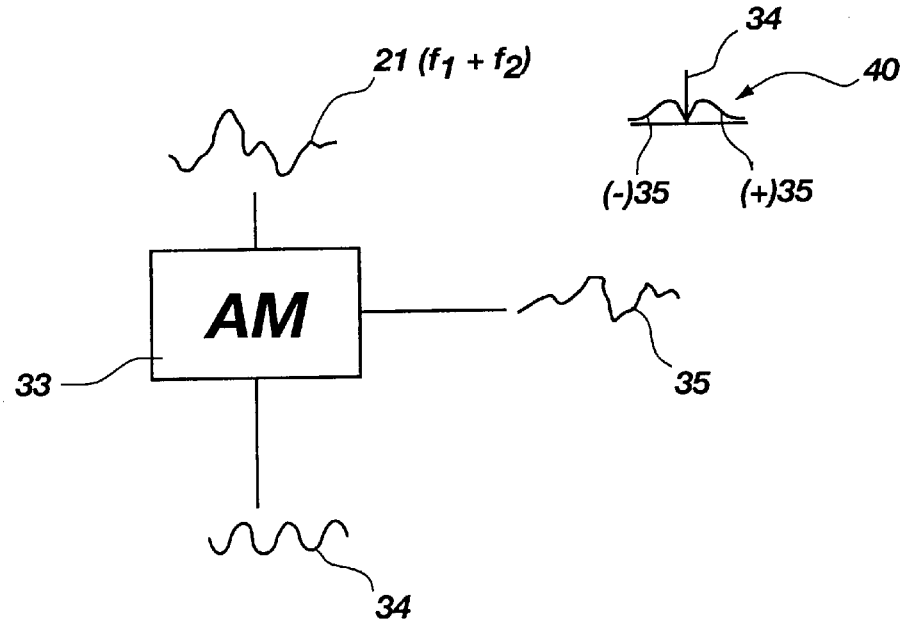
FIG. 5 graphically represents a description of signal input and output with respect to the present invention.

As is shown in FIG. 5, an ultrasonic signal is supplied to an amplitude modulator 33 and operates as the carrier frequency 34. This signal 34 is mixed with an audio signal 35 to produce modulated signal 21, which includes the bass frequency 34, plus upper and lower sidebands arising from the mixing of the audio signal 35 with the carrier frequency 34. Together this combination of carrier and sideband frequencies comprise at least two ultrasonic frequencies which interfere in the nonlinear medium of air to produce an audio output corresponding to the original audio signal 35. This is accomplished in accordance with the principles of acoustic heterodyning described above.

Returning to FIG. 4, the extent of deflection of the film diaphragm 13 follows the voltage level of the combined signals 21. This deflection will orthogonally displace the diaphragm 13 from a bias or rest position which places the diaphragm in slight tension, to various extended positions represented by dashed lines 31. Obviously, the total excursion path for the diaphragm 13 must not extend into contact with the substrate conductive surface 30, or to an extended position which is approximately parallel with the surface of the planar surface of the substrate 11. In either case, the ability of the film to vibrate in a controlled manner responsive solely on the input signal 21 would be disturbed and severe distortion would result.

The present invention is contrasted with conventional electrostatic speakers in several significant aspects. First, the structure of the emitter 10 is specially configured to provide an ultrasonic wave source which is well suited for acoustic heterodyning and generation of audio output. Specifically, the cavities 16 are engineered to be uniform and to have a resonant frequency corresponding to the frequency of the carrier signal 34. This allows maximum efficiency for the system taking advantage of the benefits of a resonant emitter having a relatively high Q. By operating the emitter 10 at peak efficiency, the amplitude of the resulting audio output is maximized. The audio sideband frequencies carried along with the carrier frequency are also maximized and are demodulated by the nonlinear response of the air where the single, modulated wave form is propagated.

The present invention develops surprising results as a parametric speaker device. It provides an array of cavities which respectively, and indirectly generate audio output within an emitted ultrasonic sound column. The occurrence of ultrasonic heterodyning within each of these columns emitted from tuned emitter elements actually reinforces the sound pressure level (SPL) at a distance from the emitters 10. As shown in FIG. 3, each emitter sector 20 propagates a column of sound 25 which is highly directional. By providing an array of many emitting sectors 20 uniformly tuned to a desired resonant frequency, a simulation of a uniform wave front is accomplished with much greater amplitude than from an electrostatic diaphragm comprising a single film operable on a single voltage source. The present inventor has discovered that by individually isolating many small emitter sectors as disclosed herein, one is able to obtain tuned resonance with surprising improvement in both directionality and SPL at greater distances.

The use of uniform cavities is also an advantage in manufacturing which is duplicatable and therefore predictable. Prior art techniques required quality control that includes careful inspection of every emitter substrate to insure that an operable surface of pits or cavities was developed. This was necessary because mechanical and chemical etching techniques produce varying results depending on differences in the environment, the materials used, and the random nature of the process. Such factors tend to produce a different surface with each process. In contrast, the present invention can be practiced with conventional molding or machining procedures. This merely requires monitoring of the molded surface. Robotic processing of the actual formation steps can thereafter be exactly duplicated.

In addition, the development of uniform cavity shapes allows optimizing of the cavity geometry. For example, specific design features in depth and curvature can be studied and refined to a most favored configuration for a desired ultrasonic/audio output. Once this configuration is identified for the application intended, the process of manufacture is simply accomplished by repeated duplication of the same information and procedure. Therefore, the total substrate surface is at optimum capacity, rather than being a product of random formation with resultant average parameter values. These economies are essential for commercial development of a competitive speaker system.

The addition of air passages or conduits 15 offers further versatility. Although such conduits may not be necessary for all applications, their presence offers several benefits. First, the open cavity configuration avoids changing resistance within the vibrating film which occurs if the air is trapped in a closed pit or cavity. Such variable resistance arises with any reduction in size of the closed cavity volume when the film is retracted to a deeper position in response to applied signal voltage because of further compression of the trapped air. This causes increased resistance to deflection of the film which translates into attenuated output of the emitter. This affects both amplitude and frequency distortion and is particularly significant for generation of audio output in accordance with acoustic heterodyning.

The conduits of the present invention allow the cavity interior to equalize with each vibration of the film. The communication between the air chamber or plenum allows air within the small cavities to displace to and from the cavity to maintain a substantially constant pressure gradient based on maintenance of uniform pressure within the chamber. This feature translates into more uniform response, greater sensitivity to signal input and enhanced amplitude for compression wave output.

Where desirable, the plenum can be adapted as a negative pressure source to supply a slight suction force to mechanically bias the film to a deflected position as shown in FIG. 3. This feature has great application in electrostatic speakers, because it permits the elimination of biasing voltage that has previously imposed additional complexity in circuitry and space requirements for speaker systems. In typical electrostatic speaker systems, a biasing voltage is required to displace the film into tension, supplying the rest position for the emitter diaphragm. This raises risk of sparking, shorting and other adverse circumstances that could disable an otherwise operative unit. By mechanically implementing biasing with a negative pressure at the back of the film, these risks are substantially eliminated. The plenum can also be temperature regulated to avoid the adverse effects of temperature shifts which would otherwise occur within trapped air, where changes in temperature and pressure change the response of the emitter generally.

Figure 6:
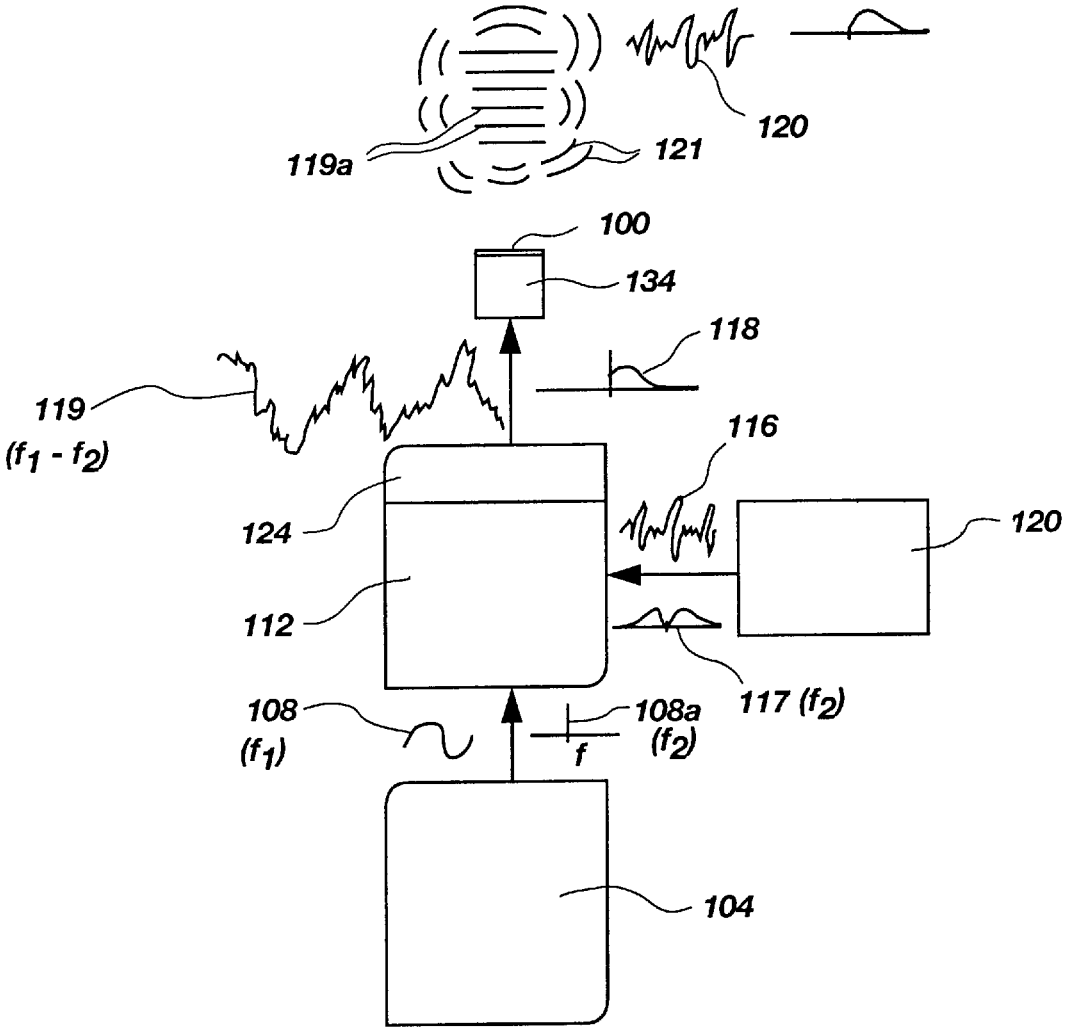
FIG. 6 provides a block diagram of a parametric speaker system utilizing the disclosed emitter.

Turning to specific implementation of the preferred embodiment of the present invention as part of a parametric system, an electrostatic diaphragm 100 can be included in the system shown in FIG. 6 supported on a driver unit 134. This application utilizes parametric or heterodyning technology, which is particularly adapted for the present thin film structure. The thin electrostatic film of the present invention is well suited for operation at high ultrasonic frequencies in accordance with parametric speaker theory.

A basic system includes an oscillator or digital ultrasonic wave source 104 for providing a base or carrier wave 108 (shown graphically as a single frequency 108*a*). This wave 108 is generally referred to as a first ultrasonic wave $f_1$, or primary wave. An amplitude modulating component 112 is coupled to the output of the ultrasonic generator 104 and receives the base frequency 108 for mixing with a sonic or subsonic input signal 116. The sonic or subsonic signal 116 may be supplied in either analog or digital form, and could be music from any convention signal source 120 or other form of sound. If the input signal 116 includes upper and lower sidebands 117, a filter component 124 may be included in the modulator to yield a single sideband output 118 or 119 on the modulated carrier frequency for selected band widths.

The electrostatic diaphragm 100 is caused to emit the ultrasonic frequencies $f_1$ and $f_2$ as a new waveform 119*a* propagated at the face of the electrostatic diaphragm 100. This new wave form interacts within the nonlinear medium of air 121 to generate the difference frequency 120, as a new sonic or subsonic wave. The ability to have large quantities of emitter sectors formed in an emitter disk is particularly well suited for generation of a uniform wave front which can propagate quality audio output at meaningful volumes.

The present invention is able to function as described because the ultrasonic signals corresponding to $f_1$ and $f_2$ interfere in air according to the principles of acoustical heterodyning. Acoustical heterodyning is somewhat of a mechanical counterpart to the electrical heterodyning effect which takes place in a non-linear circuit. For example, amplitude modulation in an electrical circuit is a heterodyning process. The heterodyne process itself is simply the creation of two new waves. The new waves are the sum and the difference of two fundamental waves.

In acoustical heterodyning, the new waves equaling the sum and difference of the fundamental waves are observed to occur when at least two ultrasonic compression waves interact or interfere in air. The preferred transmission medium of the present invention is air because it is a highly compressible medium that responds non-linearly under different conditions. This non-linearity of air enables the heterodyning process to take place, decoupling the difference signal from the ultrasonic output. However, it should be remembered that any compressible fluid can function as the transmission medium if desired.

Whereas successful generation of a parametric difference wave in the prior art appears to have had only nominal volume, the present configuration generates full sound. This full sound is enhanced to impressive volume levels because of the significant increase in orthogonal displacement of the emitter diaphragm.

The development of full volume capacity in a parametric speaker provides significant advantages over conventional speaker systems. Most important is the fact that sound is reproduced from a relatively massless radiating element. Specifically, there is no radiating element operating within the audio range because the film is vibrating at ultrasonic frequencies. This feature of sound generation in air itself by acoustical heterodyning can substantially eliminate distortion effects, most of which are caused by the radiating element of a conventional speaker. For example, adverse harmonics and standing waves on the loudspeaker cone, cone overshoot and cone undershoot are substantially eliminated because the low mass, thin film is traversing distances in millimeters.

It should also be apparent from the description above that the preferred and alternative embodiments can emit sonic frequencies directly, without having to resort to the acoustical heterodyning process described earlier. However, the greatest advantages of the present invention are realized when the invention is used to generate the entire range of audible frequencies indirectly using acoustical heterodyning as explained above.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed and desired to be secured by U.S. Letters Patent is:

1. An ultrasonic emitter device for converting electrical signals to audio output by acoustic heterodyning of ultrasonic emissions, said device comprising:

a rigid core member having a top surface which includes an array of cavities of predetermined size and including means for enhancement of at least one resonant frequency operable as a carrier frequency within an ultrasonic frequency range;

means for developing an electrostatic field at the top surface of the core member;

a resilient, dielectric diaphragm disposed in tension along the top surface and across the cavities of the core member to allow an intended range of orthogonal displacement of emitting sectors of the diaphragm which are positioned over the cavities of the core member and within a strong portion of the electrostatic field;

a conductive medium applied to one face of the diaphragm and being electrically isolated from the core member; and modulating means coupled to the conductive medium for enabling a variable electrostatic field to be applied to the diaphragm which interacts with the electrostatic field of the core member to develop a series of ultrasonic compression waves emanating from the emitting sectors of the diaphragm within a desired ultrasonic resonant frequency range which propagate the series of ultrasonic compression waves which are demoduled within a nonlinear air medium to generate audio output.

2. A device as defined in claim 1, wherein the core member includes the array of cavities having uniform concave configurations which are generally tuned to a common resonant frequency corresponding to the carrier frequency.

3. A device as defined in claim 2, wherein the common resonant frequency comprises a carrier frequency within the ultrasonic frequency range operable with a second ultrasonic frequency emitted from the same emitter device to interact in air to develop a new compression wave having a frequency equal to the difference between the carrier and the second ultrasonic frequencies.

4. A device as defined in claim 3, wherein the core member comprises a rigid plate having a flat surface with a uniform electrostatic field along the surface of the plate most adjacent the movable diaphragm.

5. A device as defined in claim 1, wherein the cavities are tooled to common dimensions.

6. A device as defined in claim 1, wherein the cavities are aligned in uniform rows.

7. A device as defined in claim 6, wherein the rows of cavities are equally spaced from adjacent rows.

8. A device as defined in claim 1, further comprising means for supplying a variable voltage to the conductive medium of the diaphragm to develop the variable electrostatic field for enabling attraction and repulsion with respect to the electrostatic field of the core member.

9. A device as defined in claim 1, wherein the diaphragm comprises a thin film having a conductive layer deposited on one side of the film proximate to the core member.

10. A device as defined in claim 9, wherein the film comprises a polymer having isotropic resilient properties across its surface to provide a uniform response to applied tension.

11. A device as defined in claim 10, wherein the polymer comprises Mylar.

12. A device as defined in claim 1, wherein the cavities have a spherical concave surface.

13. A device as defined in claim 1, wherein the core member includes air passages communicating from the cavities to a backside of the core member.

14. A device as defined in claim 13, further comprising an air chamber formed at a backside of the core member in communication with the air passages.

15. A device as defined in claim 14, further comprising negative pressure means for developing a negative pressure within the air chamber as a biasing force to pull the emitting sectors of the diaphragm into a noncontacting, concave configuration at the cavities.

16. A device as defined in claim 15, further comprising an electrical signal source electrically coupled to the conductive medium and being capable of supplying at least two ultrasonic signals for propagation from the emitting sectors of the diaphragm.

17. A device as defined in claim 16, wherein the electrical signal source includes a mixing device for mixing an ultrasonic signal with an audio signal to form a composite waveform comprising an ultrasonic carrier wave with at least one sideband within the ultrasonic frequency range.

18. A device as defined in claim 1, wherein the core member includes means for generating a biasing electrostatic field having a continuously oscillating strength selected to provide a biasing force on the diaphragm responsive to the electrostatic field at the top surface of the core member to recess the emitting sectors of the diaphragm to a baseline displacement and tension within the cavities and out of contact with the cavity.

19. A method for emitting audio output from interfering ultrasonic frequencies which include a carrier frequency and modulated side bands corresponding to mixed audio signals within the ultrasonic frequencies, the method comprising the steps of:

(a) providing a uniform array of cavities across a surface of a supporting core member wherein the array of cavities are configured to generate a predetermined ultrasonic frequency operable as the carrier frequency;

(b) maintaining a movable diaphragm in stretched configuration across the cavities and along the core member to allow an intended range of orthogonal displacement of the diaphragm with respect to the cavities and within a strong portion of a variable electrostatic field; and (c) inductively coupling a variable current flow having the modulated ultrasonic frequencies to the movable diaphragm for developing a second electrostatic field which variably interacts with the first electrostatic field to displace the diaphragm in response to the carrier frequency and modulated side bands.

20. A method as defined in claim 19, further comprising the step of fine tuning the array of cavities to a common resonant frequency.

21. A method as defined in claim 19, further comprising the step of maintaining a substantially uniform back pressure within the array of cavities.

* * * * *